US006026269A

United States Patent [19]

Setoriyama

[11] Patent Number: 6,026,269

[45] Date of Patent: Feb. 15, 2000

[54] IMAGE FORMING APPARATUS WITH VARYING CONVEYING SPEED

[75] Inventor: Takeshi Setoriyama, Kashiwa, Japan

[73] Assignee: Canon Kabushiki Kaisha, Tokyo, Japan

[21] Appl. No.: 09/111,750

[22] Filed: Jul. 8, 1998

[30] Foreign Application Priority Data

Jul. 11, 1997 [JP] Japan ..... 9-187002
Jun. 25, 1998 [JP] Japan ..... 10-178807

[51] Int. Cl.[7] ..... G03G 21/00; G03G 15/16

[52] U.S. Cl. ..... 399/302; 399/308; 399/66

[58] Field of Search ..... 399/302, 308, 399/309, 66

[56] References Cited

U.S. PATENT DOCUMENTS 5,434,657 7/1995 Berkes et al. ..... 355/273
5,438,398 8/1995 Tanigawa et al. ..... 355/271
5,621,451 4/1997 Sugiura et al. ..... 347/112
5,790,930 2/1997 Fuchiwaki ..... 399/302

*Primary Examiner*—Richard Moses
*Attorney, Agent, or Firm*—Fitzpatrick, Cella, Harper & Scinto

[57] ABSTRACT

An image forming apparatus has a rotatable image bearing member for bearing a toner image, a rotatable intermediate transfer member onto which the toner image on the image bearing member is transferred at a first transfer position, a rotatable transfer roller for transferring the toner image on the intermediate transfer member onto a transfer material at a second transfer position, and a rotatable conveyer for conveying the transfer material to the transfer roller at a conveying position. The transferring of the toner image from the image bearing member to the intermediate transfer member and the transferring of the toner image from the intermediate transfer member to the transfer material may occur simultaneously, and, a conveying speed of the transfer material provided by the conveyer is higher than a conveying speed of the transfer material at the second transfer position, and the conveying speed of the transfer material at the second transfer position is higher than a rotating speed of the transfer roller at the second transfer position.

23 Claims, 4 Drawing Sheets

A

IMAGE FORMING APPARATUS WITH VARYING CONVEYING SPEED

BACKGROUND OF THE INVENTION

1. Field of the Invention

The present invention relates to an image forming apparatus such as a copying machine, a printer, a facsimile and the like.

2. Related Background Art

In a conventional image forming apparatus as shown in FIG. 5, a toner image formed on a drum-shaped electrophotographic photosensitive member (referred to as "photosensitive drum" hereinafter) 101 is firstly-transferred onto an intermediate transfer member 105 once and then the toner image transferred to the intermediate transfer member is secondary-transferred onto a transfer material P by a secondary transfer roller 108, thereby forming an image. This image forming apparatus is effective as a color image forming apparatus or a multi-color image forming apparatus in which a plurality of color component images of color image information or multi-color image information are successively transferred in a superimposed fashion to reproduce and output a color image or a multi-color image, or an image forming apparatus having a color image forming function or a multi-color image forming function.

In the image forming apparatus capable of forming the color image, conventionally, the peripheral rotation speed of the photosensitive drum 1 is selected to be same as that of the intermediate transfer member 105, and the peripheral rotation speed of the intermediate transfer member 105 is selected to be equal to those of the secondary transfer roller 108, a pair of regist rollers 109, and a pair of fixing rollers 110 of a fixing device. The intermediate transfer member 105 is urged against the photosensitive drum 101 with predetermined pressure to form a nip (first transfer station) 106*a* at which the plurality of color toner images formed on the photosensitive drum 101 are successively firstly-transferred onto the intermediate transfer member 105 in the superimposed fashion. The secondary transfer roller 108 is disengaged from the intermediate transfer member 105 until the plurality of toner images are superimposed on the intermediate transfer member 105, and is urged against the intermediate transfer member 105 at a timing for collectively transferring the plural color toner images are transferred onto the transfer material P.

Further, the pair of regist rollers 109 is disposed at an upstream side of the secondary transfer roller 108 in a conveying direction for the transfer material P and cooperates with the intermediate transfer member 105 to convey the transfer material P at a predetermined timing so that the plural color toner images on the intermediate transfer member 105 are secondary-transferred onto a predetermined position on the transfer material P at a secondary transfer nip 106*b*. The pair of fixing rollers 110 of the fixing device are disposed at a downstream side of the secondary transfer roller in the transfer material conveying direction so that non-fixed color toner images on the transfer material P are fixed to the transfer material P with predetermined pressure and heat.

By the way, in the above-mentioned conventional image forming apparatus, since the photosensitive drum 101 and the intermediate transfer member 105 are statically pressurized against each other at the nip (first transfer nip) 106*a* between the photosensitive drum 101 and the intermediate transfer member 105, when each color toner image on the photosensitive drum 101 is transferred onto the intermediate transfer member 105, poor transferring (void) may occur at a central portion of the toner image. For example, as shown in FIG. 6, in case of alphabet "A", edges of the character may be emphasized due to the void to form a hollow character.

Further, if the peripheral speed of the intermediate transfer member 105, secondary transfer roller 108, pair of regist rollers 109 or fixing rollers 110 of the fixing device is differentiated from the other peripheral speeds, the conveying speeds for the transfer material P will not become constant between the units. As a result, the image quality is worsened due to transfer deviation or the image is not formed on the predetermined position on the transfer material P or tip and/or trail ends of the toner image are expanded or contracted, thereby worsening positioning accuracy for forming the toner image.

Further, if the shifting speed of the transfer material P being passed through the secondary transfer nip 106*b* becomes slower than the peripheral speed of the intermediate transfer member 105, the intermediate transfer member will be braked. Further, if the transfer material conveying speed of the pair of regist rollers 109 becomes slower than the peripheral speed of the intermediate transfer member 105, the intermediate transfer member 105 is pulled by the transfer material P to brake the intermediate transfer member 105. As a result, in an arrangement in which a circumferential distance from the first transfer nip 106*a* to the secondary transfer nip 106*b* in a rotational direction of the intermediate transfer member 105 is smaller than a length of the toner image to be formed, when the secondary transferring of the tip end portion of the last color toner image is started while such toner image is being firstly-transferred, or when the firstly transferring of a next first color toner image is started during the secondary transferring of the preceding toner image, there arises rotational unevenness of the intermediate transfer member 105 or urging force between the intermediate transfer member 105 and the photosensitive drum 101 at the first transfer nip 106*a* is changed.

For this reason, for example, when a full-color image is formed, there arises positional deviation between the first to third color toner images firstly-transferred to the intermediate transfer member 105 and fourth color (last color) toner image or positional deviation (color deviation) between the next first color toner image to be firstly-transferred and the second to fourth color toner images.

SUMMARY OF THE INVENTION

An object of the present invention is to provide an image forming apparatus in which positional deviation between toner images formed on an intermediate transfer member which caused by the braking of the intermediate transfer member can be prevented.

The other objects and features of the present invention will be apparent from the following detailed explanation referring to the accompanying drawings.

DETAILED DESCRIPTION OF THE PREFERRED EMBODIMENTS

The present invention will now be explained in connection with embodiments thereof with reference to the accompanying drawings.

(First Embodiment)

Figure 1:
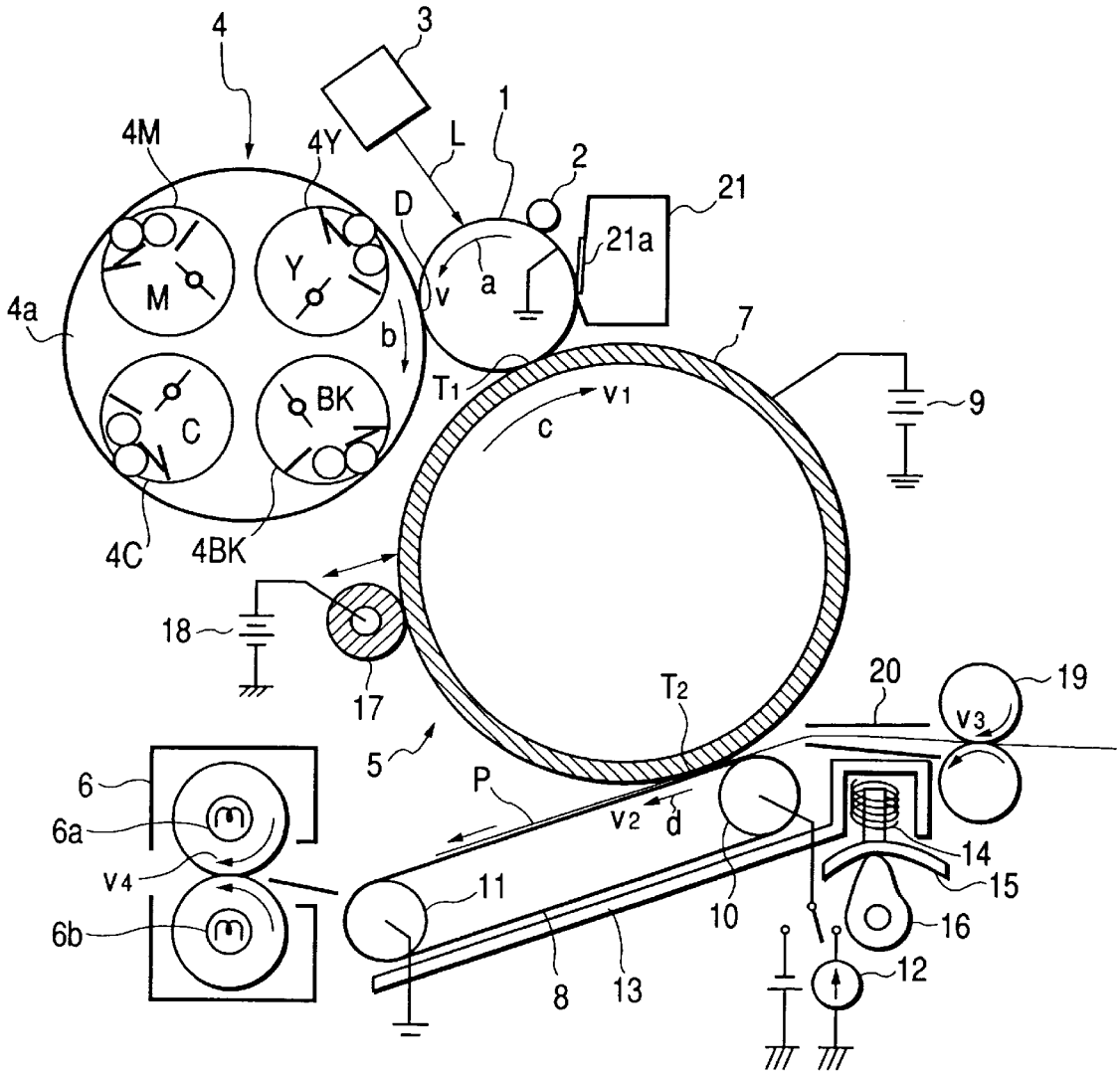
FIG. 1 is a schematic view showing an image forming apparatus according to a first embodiment of the present invention.

FIG. 1 is a schematic view showing an image forming apparats (laser beam printer capable of forming a color image) according to a first embodiment of the present invention. The image forming apparatus comprises a photosensitive drum 1, a charge roller 2, an exposure device 3, a developing means 4, a transfer device 5 and a fixing device 6.

In the illustrated embodiment, the photosensitive drum 1 is a negatively charged organic photosensitive body having a diameter of 62 mm and is constituted by an aluminium drum base (not shown) and a photo-conductive layer (not shown) coated on the drum base, and is rotated at a predetermined peripheral speed (process speed) V in a direction shown by the arrow a. The charge roller 2 is urged against a surface of the photosensitive drum 1 with a predetermined urging force and is rotatingly driven by rotation of the photosensitive drum 1. By applying predetermined charge bias (for example, voltage obtained by overlapping AC voltage with DC voltage) from a charge bias power source (not shown) to the charge roller 2, the photosensitive drum 1 is negatively charged with predetermined potential.

The developing means 4 includes a rotary 4*a* on which an yellow (Y) developing device 4Y, a magenta (M) developing device 4M, a cyan (C) developing device 4C and a black (BK) developing device 4BK are mounted. By rotating the rotary 4*a* by a rotation drive device (not shown) in a direction shown by the arrow b, any developing device selected among the yellow developing device 4Y, magenta developing device 4M, cyan developing device 4C and black developing device 4BK can be opposed to the photosensitive drum 1 at a developing station D. Toner (developing agent) is non-magnetic toner having average particle diameter of 8.5 $\mu$m. Average toner tribo under normal environment (temperature of 25° C., relative humidity of 50%) is about −25 $\mu$C/g.

The transfer device 5 includes an intermediate transfer drum (intermediate transfer member) 7 having roller-shaped multi-layer structure, and a transfer belt (secondary transferring means) 8 for effecting secondary-transferring. The intermediate transfer drum 7 abuts against the photosensitive drum 1 at a first transfer nip (first transfer station) $T_1$ and the transfer belt 8 can abut against the intermediate transfer drum 7 at a second transfer nip (second transfer station) $T_2$. The intermediate transfer drum 7 is rotatingly driven at a peripheral speed V1 (difference in speed between the peripheral speed V1 and a peripheral speed V of the photosensitive drum 1 rotated in the direction c is 1% or less). A first transfer bias power source 9 is connected to the intermediate transfer drum 7 so that predetermined first transfer bias (DC voltage) having positive polarity can be applied to the intermediate transfer drum 7.

In the illustrated embodiment, in order to provide the difference in speed between the peripheral speed V1 of the intermediate transfer drum 7 and the peripheral speed V of the photosensitive drum 1 is 1% or less, in comparison with an image forming apparatus in which the photosensitive drum and the intermediate transfer drum are rotated at the same peripheral speed, the diameter of the intermediate transfer drum 7 is slightly increased.

The transfer belt 8 is an endless belt rotatably supported in parallel with the intermediate transfer drum 7 and contacted with the intermediate transfer drum 7 from the below and wound around a transfer roller (bias roller) 10 and a drive roller (tension roller) 11 in a tension condition. An upper run of the belt is shifted at a peripheral speed V2 in a direction shown by the arrow d by rotation of the drive roller 11. A second transfer bias power source 12 is connected to the transfer roller 10 so that predetermined second transfer bias (DC voltage) can be applied to the transfer roller 10.

The transfer roller 10 is constituted by a metallic substrate layer and a conductive urethane rubber surface layer (having resistance of about $10^4$ to $10^7\Omega$) and has entire resistance of $10^4\Omega$ or less. The transfer belt 8 has two-layer structure including a substrate layer made of thermosetting urethan elastomer and a surface layer made of vinylidene fluoride rubber and has a thickness of 0.3 mm and entire resistance of $10^{10}\Omega$. An extension rate of the transfer belt 8 when it mounted between the transfer roller 10 and the drive roller 11 is about 5%.

The transfer roller 10 and the drive roller 11 are supported by a transfer frame 13 via bearings, and a pressurizing spring and a pressurizing sub-roller 15 are disposed at one end of the transfer frame 13. The pressurizing sub-roller 15 is supported by a pressurizing cam 16, so that the transfer belt 8 can be engaged by and disengaged from the intermediate transfer member 7 at a predetermined timing by rotating the pressurizing cam 16 by means of an electromagnetic clutch (not shown) and a drive means (not shown). The transfer roller 10 is urged against the intermediate transfer member 7 by a spring force of the pressurizing spring 14 with predetermined secondary transfer pressure (total pressure of about 4 Kg in the illustrated embodiment).

An intermediate transfer member cleaning roller 17 having roller-shaped multi layer structure can be engaged by and disengaged from an outer peripheral surface of the intermediate transfer member 7. Predetermined bias voltage having polarity (positive polarity) opposite to normal charging polarity of toner is applied from a cleaning bias power source 18 to the intermediate transfer member cleaning roller 17.

Next, an image forming operation of the image forming apparatus will be explained.

During image formation, the photosensitive drum 1 is rotatingly driven at the predetermined peripheral speed (process speed) V in the direction a by the drive means (not shown) and is uniformly charged with predetermined negative potential by the charge roller 2 to which the predetermined charge bias was applied. By illuminating image exposure L (laser beam) corresponding to image information from the exposure device 3 onto the photosensitive drum 1, an electrostatic latent image corresponding to a first color component image (for example, an yellow color component image) of a target color image is formed on the photosensitive drum. Then, the electrostatic latent image is developed by the yellow developing device 4Y to form an yellow (first color) toner image.

While the first color yellow toner image formed on the photosensitive drum 1 is being passed through the first transfer nip $T_1$ between the photosensitive drum 1 and the intermediate transfer drum 7, the yellow toner image is firstly-transferred (intermediate transferring) onto the intermediate transfer drum 7 by pressure at the first transfer nip $T_1$ and an electric field generated the first transfer bias applied from the first transfer bias power source 9 to the substrate layer of the intermediate transfer drum 7. Similarly, a second color magenta toner image, a third color cyan toner image and a fourth color black toner image formed on the photosensitive drum 1 by the magenta developing device 4M cyan developing device 4C and black developing device 4BK are successively transferred onto the intermediate transfer drum 7 in a superimposed fashion, thereby forming a resultant color toner images corresponding to the target color image. Such process is called as firstly-transferring.

In this case, in order to successively transfer the first to fourth color toner images from the photosensitive drum 1 to the intermediate transfer drum 7 in the superimposed fashion, the first transfer bias applied from the first transfer bias power source 9 has polarity (positive polarity) opposite to normal charging polarity of toner. Incidentally, in the transferring process for transferring the first to fourth color toner images from the photosensitive drum 1 to the intermediate transfer drum 7 in the superimposed fashion, the transfer belt 8 and the intermediate transfer member cleaning roller 17 are spaced apart from the intermediate transfer drum 7.

The transfer material P such as a paper sheet is supplied from a sheet supply cassette (not shown) to the second transfer nip $T_2$ between the intermediate transfer drum 7 and the transfer belt 8 through a pair of regist rollers 19 and a pre-transfer guide 20. In this case, the pair of regist rollers 19 are rotated at a predetermined peripheral speed V3. A distance from a nip (convey position) of the paired regist rollers 19 to the second transfer nip $T_2$ is selected to be smaller than a transfer material having an available minimum size (conveying direction). In this case, the second transfer bias is applied from the second transfer bias power source (constant current power source) 12 to the transfer roller 10, so that the resultant color toner images successively transferred (firstly-transferred) to the intermediate transfer drum 7 in the superimposed fashion are secondary-transferred onto the transfer material P. In this case, the second current is controlled with constant current to become +10 $\mu$A. This process is called as secondary-transferring.

The transfer material P to which the resultant color toner images were secondary-transferred is absorbed and conveyed by the transfer belt 8 having great electrostatic capacity and then is separated from the transfer belt due to curvature of the belt at a downstream separation position. The separated transfer material is then sent to a nip (fixing station) between paired rollers 6*a,* 6*b* of the fixing device 6, where the transfer material is heated and pressurized by the heating roller 6*a* and the pressure roller 6*b* of the fixing device 6, thereby fixing the resultant color toner images to the transfer material P. A distance from the separation position where the transfer material P absorbed and conveyed by the transfer belt 8 is separated from the transfer belt 8 to the nip between the pair of fixing rollers 6*a,* 6*b* of the fixing device 6 is selected to be smaller than the transfer material having an available minimum size (conveying direction).

Further, secondary-transferring residual toner remaining on the intermediate transfer drum 7 which was not transferred is charged with positive polarity opposite to the normal charging polarity of toner by the intermediate transfer member cleaning roller 17 to which predetermined bias voltage having positive polarity was applied from the cleaning bias power source 18. Then, the residual toner is electrostatically absorbed to the photosensitive drum 1 at the first transfer nip $T_1$, thereby cleaning the intermediate transfer drum 7. Thereafter, the secondary-transferring residual toner absorbed to the photosensitive drum 1 is collected by a cleaning blade 21*a* of a cleaning device 21.

Next, the intermediate transfer drum 7 used in the firstly-transferring process will be fully described.

The intermediate transfer drum 7 used in the illustrated embodiment is of roller-shaped multi-layer structure including a cylindrical conductive support (substrate layer), an elastic layer made of at least rubber, elastomer and resin and coated on the conductive support, and one or more surface layers made of resin and coated on the elastic layer. The conductive support of the intermediate transfer drum 7 can be made of metal such as aluminium, iron, copper or an alloy thereof, or conductive resin in which carbon or metallic powder is dispersed, and may be formed from a cylinder, or, a cylinder having a central shaft, or a cylinder having an internal reinforcement. In the illustrated embodiment, an aluminium cylinder having a thickness of 3 mm and having an internal reinforcement is used as the cylindrical conductive support.

A thickness of the elastic layer of the intermediate transfer drum 7 is desirable to be selected to 0.5 to 7 mm in consideration of the formation of the first and second transfer nips $T_1$, $T_2$, color deviation due to rotation of the drum and material cost, and, a thickness of the surface layer of the intermediate transfer drum 7 is preferably selected to form a thin layer for permitting to transmit elasticity of the underlying elastic layer to the surface layer and the photosensitive drum 1. More specifically, the thickness of the surface layer is desirable to be selected to 20 to 200 $\mu$m. In the illustrated embodiment, the thickness of the elastic layer was 5 mm, the thickness of the surface layer was 30 $\mu$m, and the total diameter $\phi$ of the intermediate transfer drum 7 was 185.65 mm.

Further, the elastic layer is controlled to have volume resistance of $10^5$ to $10^8$ $\Omega$·cm by dispersing Ketchen black (conductive material) into acrylonitrile-butadiene rubber (NBR) by making much of resistance alone. In the illustrated embodiment, the volume resistivity of the elastic layer was selected to The surface layer of the intermediate transfer drum 7 is formed by dispersing PTFE powder of 200 parts into urethane resin (as binder). In the formation of the surface layer, the surface layer is sprayed on the elastic layer and then is polished. The resistance value of the intermediate transfer drum 7 so formed was $2\times10^7\Omega$.

The resistance value of the intermediate transfer drum 7 was measured by cutting the rubber portion of an intermediate transfer drum similar to the intermediate transfer drum 7 to a sheet having dimension of 100×100 mm and by measuring the resistance by using R8340 and R12704 (machine name) manufactured by Advantest Inc. under the conditions of applied voltage=100 V, discharge=5 sec, charge=30 sec and measure=30 sec. The measuring device can measure the volume resistivity, surface resistance and actual resistance of the intermediate transfer drum 7, and, the resistance value used in the illustrated embodiment means the actual resistance.

The electrostatic capacity value of the intermediate transfer drum 7 was measured by cutting the rubber portion of an intermediate transfer drum similar to the intermediate transfer drum 7 to a sheet having dimension of 100×100 mm and by resting the sheet on an aluminium electrode and arranging an electrode having a diameter of 50 mm on the sheet and by measuring the resistance by using ANDOAG-4304LCR meter (trade name) manufactured by ANDO Electric Co., Ltd. under the conditions of applied voltage=1 V and frequency=1 KHz. The electrostatic capacity used in the illustrated embodiment means the value measured by the above method. The measurement of the volume resistance, actual resistance and electrostatic capacity was effected under a normal temperature and normal humidity condition.

In an image forming apparatus using the intermediate transfer drum 7 as mentioned above, in many cases, since the diameter of the intermediate transfer drum 7 is greater than the diameter of the photosensitive drum 1, the transfer material P is mainly separated by the transfer belt 8. Since the intermediate transfer drum 7 is a transfer medium, an intermediate resistance area of $10^7$ to $10^8\Omega$ is required or obtaining high transferring efficiency. In such a case, since the electrostatic capacity and the resistance value are greatly varied with the change in environmental condition in comparison with the photosensitive drum 1, the separation of the transfer material P from the intermediate transfer drum 7 becomes very difficult.

Accordingly, in order to reserve high separating ability through a low humidity environmental condition to a high humidity environmental condition, a transfer belt 8 having good balance between the electrostatic capacity and the resistance must be used. Further, high transferring efficiency of the transfer belt is required for secondary-transferring the images once transferred to the intermediate transfer drum 7 onto the transfer material, with the result that there is a danger of deviating the resistance value providing the optimum transferring efficiency from the above-mentioned resistance value.

Further, as shown in Table 1, the electrostatic capacity of the intermediate transfer drum 7 used in the illustrated embodiment is changed between the low humidity environmental condition and the high humidity environmental condition, and the electrostatic capacity of the transfer belt 8 is changed similarly.

TABLE 1

| Environmental temperature and humidity | Electrostatic capacity of intermediate transfer drum | Electrostatic capacity of transfer belt |
|---|---|---|
| 20° C., 10% RH | 0.5 nF | 0.80 nF |
| 25° C., 50% RH | 0.2 nF | 0.65 nF |
| 30° C., 80% RH | 0.3 nF | 0.50 nF |

As apparent from the Table 1, since the transfer belt 8 has the electrostatic capacity greater than that of the intermediate transfer drum 7 through the low humidity environmental condition and the high humidity environmental condition, and the resistance fluctuation of the transfer belt is greater than that of the intermediate transfer drum 7, the stable separation can be achieved.

Further, when the toner images on the photosensitive drum 1 are successively transferred onto the intermediate transfer drum 7 in the superimposed fashion at the first transfer nip $T_1$, since not only the first transfer bias is applied between the photosensitive drum 1 and the intermediate transfer drum 7 but also the total urging force of about 15 Kg and difference in peripheral speed of 1% or less are selected, the toner images on the photosensitive drum 1 are firstly-transferred onto the intermediate transfer drum 7 in such a manner that they are scraped from the photosensitive drum.

If the peripheral speed of the photosensitive drum 1 is equal to that of the intermediate transfer drum 7, the first transfer bias and the static pressure of about 15 Kg are applied. In this case, since the pressure distribution on the toner image is smaller at its central portion than at its peripheral portion, the poor transferring such as void will occur. However, by providing the difference in peripheral speed of 1% or less between the photosensitive drum 1 and the intermediate transfer drum 7, the sharp resultant color toner images having no void can be formed on the intermediate transfer drum 7.

Now, the formation of the resultant color toner images having no void will be fully described.

Figures 2, 3:
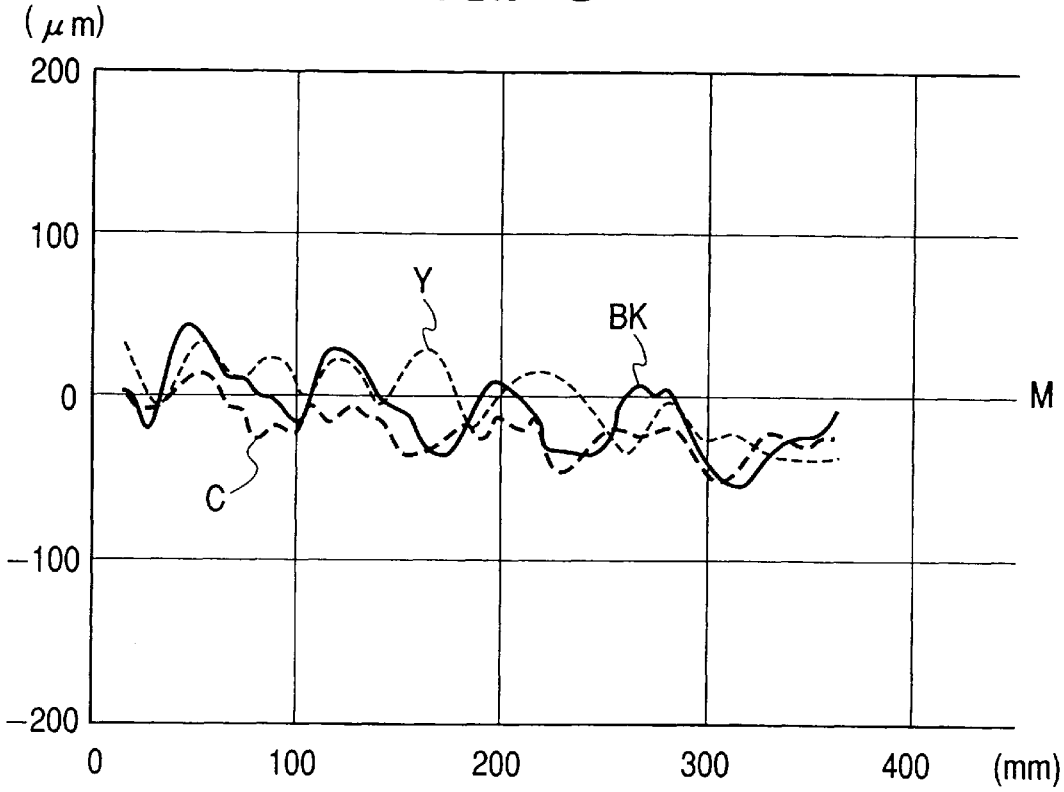
FIG. 2 is an explanatory view showing an example of an image formed by the image forming apparatus of FIG. 1.
FIG. 3 is a view showing measured results of color deviation (magenta color reference) in the image forming apparatus of FIG. 1.

In the illustrated embodiment, tests were effected under a condition that the outer diameter of the photosensitive drum 1 is selected to 62 mm, the outer diameter of the intermediate transfer drum 7 is selected to 185.65 mm, the peripheral speeds of the photosensitive drum and the intermediate transfer drum are selected to 117.1 mm/s and 116.7 mm/s, respectively, and the difference in peripheral speed between the photosensitive drum 1 and the intermediate transfer drum 7 is about 0.3%. As shown in FIG. 2, it was found that the resultant color toner images (alphabet "A") on the intermediate transfer drum 7 has no void. Further, as shown in FIG. 3, when the magenta color is used as reference, it was found that an amount of color deviation between the resultant four color (yellow, magenta, cyan and black) toner images is 100 $\mu$m or less.

In the past, if the peripheral speed of the photosensitive drum differs from that of the intermediate transfer drum, since the resultant color images on the intermediate transfer drum 7 cause image deviation (color deviation), it was considered that the image forming apparatus causing such color deviation cannot be used practically. However, as apparent from the above-mentioned test results, color deviation of about 100 $\mu$m can be used practically, and the present invention capable of preventing void is very effective.

Further, tests was effected under the condition that the difference in peripheral speed between the photosensitive drum 1 and the intermediate transfer drum 7 is 1% or more. As a result, it was found that the void can be prevented but the color deviation becomes 200 $\mu$m or more. This is not practical. Accordingly, by maintaining the difference in peripheral speed between the photosensitive drum 1 and the intermediate transfer drum 7 to 1% or less (preferably, 0.5% or less), the void and color deviation of the resultant color toner images can be prevented.

As mentioned above, when the four color (yellow, magenta, cyan and black) resultant toner images are formed on the intermediate transfer drum 7, the transfer material P is conveyed to the second transfer nip $T_2$ by the pair of regist rollers 19 through the pretransfer guide 20 at a timed relation to the toner images on the intermediate transfer drum 7. In this case, the transfer roller 10 is urged against the intermediate transfer drum 7 with predetermined second transfer pressure (total pressure of 4 Kg in the illustrated embodiment), so that the toner images are secondary-transferred onto the transfer material P.

The transfer material P to which the toner images were transferred is electrostatically absorbed and conveyed by the transfer belt 8 to be directed to the nip between the heat roller 6*a* and the pressure roller 6*b* of the fixing device 6, where the toner images are fixed to the transfer material with heat and pressure.

In this case, although it is desirable that peripheral speeds of the intermediate transfer drum 7, pair of regist rollers 19, transfer belt 8 and the heat roller 6*a* (pressure roller 6*b*) of the fixing device 6 are equal, if the peripheral speed of at least one of the pair of regist rollers 19, transfer belt 8 and the heat roller 6*a* (pressure roller 6*b*) of the fixing device 6 differs from the peripheral speed of the intermediate transfer drum 7, the conveying speed of the transfer material P will be changed partially, with the result that the intermediate transfer drum 7 is braked by the transfer material P.

Consequently, the peripheral speed of the intermediate transfer drum 7 is changed to cause rotational unevenness, with the result that, in an arrangement in which a circumferential distance from the first transfer nip $T_1$ to the secondary transfer nip $T_2$ in a rotational direction of the intermediate transfer drum 7 is smaller than a length of the toner image to be formed, when the secondary transferring of the tip end portion of the last color toner image is started while such toner image is being firstly-transferred, or when the firstly transferring of a next first color toner image is started during the secondary transferring of the preceding toner image. Thus, there arises positional deviation (color deviation) between first to third color toner images to be firstly-transferred to the intermediate transfer drum 7 and the fourth color (last color) toner image or positional deviation (color deviation) between the next first color toner image to be firstly-transferred and the second to fourth color toner images.

Further, at the second transfer nip $T_2$, if the peripheral speed of the transfer belt 8, i.e., the conveying speed of the transfer material P is equal to the peripheral speed of the intermediate transfer drum 7, as mentioned above, at the second transfer nip $T_2$, the resultant color toner images secondary-transferred to the transfer material P is apt to generate void for the same reason that at the first transfer nip $T_1$.

Thus, when it is assumed that the peripheral speed of the intermediate transfer drum 7 at the second transfer nip $T_2$ is $V_1$, the conveying speed of the transfer material P at the second transfer nip $T_2$ (equal to the peripheral speed of the transfer belt 8 in the illustrated embodiment), is $V_2$, the conveying speed of the transfer material P given by the pair of regist rollers 19 (equal to the peripheral speed of the pair of regist rollers 19 in the illustrated embodiment) is $V_3$, and the conveying speed of the transfer material P given by the heat roller 6*a* and the pressure roller 6*b* (equal to the peripheral speeds of the heat roller 6*a* and the pressure roller 6*b* in the illustrated embodiment) is $V_4$, they are selected to satisfy the following relations:

$$V_1<V_2, \text{ and}$$

$$V_2<V_3 \quad (1)$$

In order to prevent the color deviation from becoming excessively, it is preferable to satisfy a relation $1.001 \leqq V_2/V_1 \leqq 1.005$. Further, on the way that the toner images are being secondary-transferred onto the transfer material P, in order to prevent the transfer material from being pulled by the heat roller 6*a* and the pressure roller 6*b* to cause the poor transferring, the values are set to satisfy the following relation (2):

$$V_4<V_1<V_2<V_3 \quad (2)$$

In order to satisfy the above relation (1), in the illustrated embodiment, first of all, a predetermined test toner image is formed on the intermediate transfer drum 7, and a length A of the test toner image along the rotational direction of the intermediate transfer drum 7 is measured before the test toner image is transferred onto the transfer material (for example, a paper sheet). Then, an image same as the test toner image is transferred from the intermediate transfer drum 7 to the transfer material (for example, the paper sheet), and a length B of the test toner image along the transfer material conveying direction before the toner image is fixed by the fixing device 6.

If the lengths A, B of two test toner images have a relation A<B and a predetermined loop is formed in the transfer material between the nip of the paired regist rollers 19 and the second transfer nip, the above relation (1) ($V_1<V_2$, and $V_2<V_3$) will be satisfied. Further, if $1.001 \leqq B/A \leqq 1.005$, the relation $1.001 \leqq V_2/V_1 \leqq 1.005$ is satisfied.

A tape was used to measure the lengths A, B. The tape is a transparent polyester tape No. 550 (#25) manufactured by NICHIBAN Co., Ltd. and having a width of 18 mm. More specifically, when the length A is measured, the test toner image on the intermediate transfer drum 7 before the secondary-transferring is transferred to the tape, and the tape with the toner image is adhered to a predetermined sheet (for example, a scaled sheet) to thereby measure the length A of the test toner image. Similarly, after the secondary-transferring to the transfer material (for example, the paper sheet) and before the fixing, the test toner image is transferred to the tape thereby to measure the length B of the test toner image.

As another method, by using a laser beam, the conveying speed of the transfer material at the second transfer nip (substantially equal to the peripheral speed of the transfer belt 8, in the illustrated embodiment) and the peripheral speed of the intermediate transfer drum 7 at the second transfer nip can be measured.

The principle of this measurement is that, when the laser beam is illuminated on an object to be measured (surface of the intermediate transfer drum 7 or surface of the transfer material (for example, the paper sheet)) from a position spaced apart from the object by a predetermined distance, a spectrum pattern (speckled pattern including bright portions and dark portions) is generated, and the spectrum pattern is received by a sensor head with one-dimension image. The spectrum pattern is also shifted in the same direction. Thus, by calculating the shifting amount in an analysis circuit of an amplifier unit, the speed can be sought.

In this case, the transfer material conveying speed at the second transfer nip and the peripheral speed of the intermediate transfer drum 7 at the second transfer nip are measured, by assuming that, before the fixing, in a condition that the transfer material is pinched at the second transfer nip, the former speeds are substantially equal to the conveying speed of a portion of the transfer material which has passed through the second transfer nip and the peripheral speed of the intermediate transfer drum 7 measured at a desired position (other than the second transfer nip) where the measurement can easily be effected, respectively. The transfer material conveying speed provided by the pair of regist rollers 19 or the pair of fixing rollers 6*a*, 6*b* can be measured by the above-mentioned method at a downstream side of the second transfer nip.

A sensor head FC-2010 and an amplifier unit FC-2000 manufactured by Keyence Inc. can be used as the measuring device.

In the illustrated embodiment, the peripheral speeds of the intermediate transfer drum 7, transfer belt 8, pair of regist rollers 19 and heat roller 6*a* and pressure roller 6*b* of the fixing device 6 are adjusted appropriately to satisfy the above relations (1) and (2).

By setting the peripheral speed relation between the intermediate transfer drum 7 the units (transfer belt 8, pair of regist rollers 19, heat roller 6*a* and pressure roller 6*b* of the fixing device 6) for conveying the transfer material P to satisfy the above relations (1) and (2), even when the transfer material P is conveyed by any one of the units (transfer belt 8, pair of regist rollers 19, heat roller 6*a* and pressure roller 6*b* of the fixing device 6), the intermediate transfer drum 7 is not braked, thereby stabilizing the peripheral speed.

That is to say, by setting the peripheral speed of the upstream side (pair of regist rollers 19) of the transfer material convey path to always become greater than the peripheral speed of the downstream side (heat roller 6*a* and pressure roller 6*b* of the fixing device 6) of the transfer material convey path, since the excessive tension is not applied to the transfer material P being secondary-transferred at the second transfer nip $T_2$, the peripheral speed of the intermediate transfer drum 7 is stabilized. Further, under the above relations (1) and (2), as mentioned above, by setting the difference in peripheral speed between the photosensitive drum 1 and the intermediate transfer drum 7 at the first transfer nip $T_1$ to become 1% or less, the color deviation can be suppressed below about 100 $\mu$m.

The differences in peripheral speed between the intermediate transfer drum 7, transfer belt 8, pair of regist rollers 19, heat roller 6*a* and pressure roller 6*b* of the fixing device 6 have different optimum values in accordance with the relative distances between the units (transfer belt 8, pair of regist rollers 19, heat roller 6*a* and pressure roller 6*b* of the fixing device 6) and functions thereof. Thus, in the illustrated embodiment, a distance between the pair of regist rollers 19 and the absorb start position for starting the absorption of the transfer material to the transfer belt 8 is selected to become smaller than a minimum size (minimum in the transfer material conveying direction) transfer material available to the apparatus. Further, a distance between the separation position where the transfer material P is separated from the transfer belt 8 and the nip (between the heat roller 6*a* and the pressure roller 6*b*) of the fixing device 6 is also selected to become smaller than the minimum size (minimum in the transfer material conveying direction) transfer material available to the apparatus.

Since the pair of regist rollers 19 serve to convey the transfer material P in a timed relation to the resultant color toner images on the intermediate transfer drum 7, the difference in peripheral speed between the intermediate transfer drum 7 and the conveying speed of the transfer material P (transfer belt 8) at the second transfer nip $T_2$ is desirable to be smaller. It is preferable that the difference in peripheral speed between the intermediate transfer drum 7 and the conveying speed of the transfer material P provided by the pair of regist rollers 19 (pair of regist rollers 19) is about 1% and the difference in peripheral speed between the intermediate transfer drum 7 and the conveying speed of the transfer material P (transfer belt 8) at the second transfer nip $T_2$ is about 0.5%. Further, since the distance between the second transfer nip $T_2$ and the fixing device 6 is long, if the difference in peripheral speed between the transfer belt 8 and the heat roller 6*a* (pressure roller 6*b*) of the fixing device 6 becomes great, slack (loop) in the transfer material P is increased, with the result that the transfer material P to which the non-fixed resultant color toner images were transferred may be contacted with other part(s) of the apparatus to deteriorate the resultant color toner images.

Accordingly, in the illustrated embodiment, the difference between the peripheral speed of the intermediate transfer drum 7 and the peripheral speed of the heat roller 6*a* (pressure roller 6*b*) of the fixing device 6 is selected to about 2%. Under the above conditions, tests were performed. It was found that the color deviation is 100 $\mu$m or less through the entire area of the transfer material P having A3 size and the high quality color image having no void can be obtained.

In this way, according to the illustrated embodiment, in the color image forming apparatus using the intermediate transfer member, the high quality color image having no poor transferring such as void can be obtained, and deviation (color deviation) caused when the color toner images are superimposed on the intermediate transfer member can be reduced stably. Further, the conveyance of the transfer material P and the secondary-transferring to the transfer material P can be effected stably.

(Second Embodiment)

Figure 4:
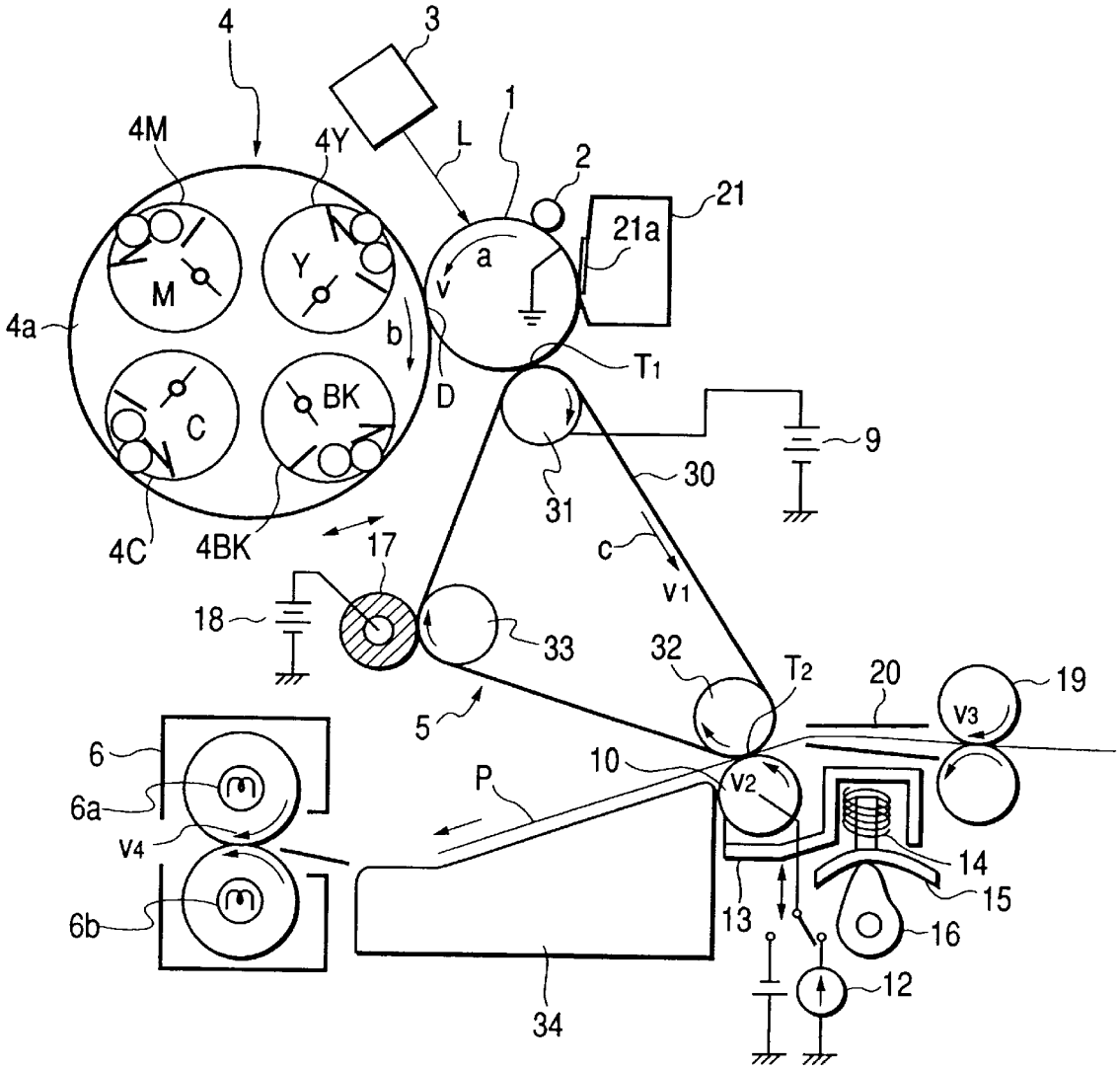
FIG. 4 is a schematic view showing an image forming apparatus according to a second embodiment of the present invention.
Figure 5:
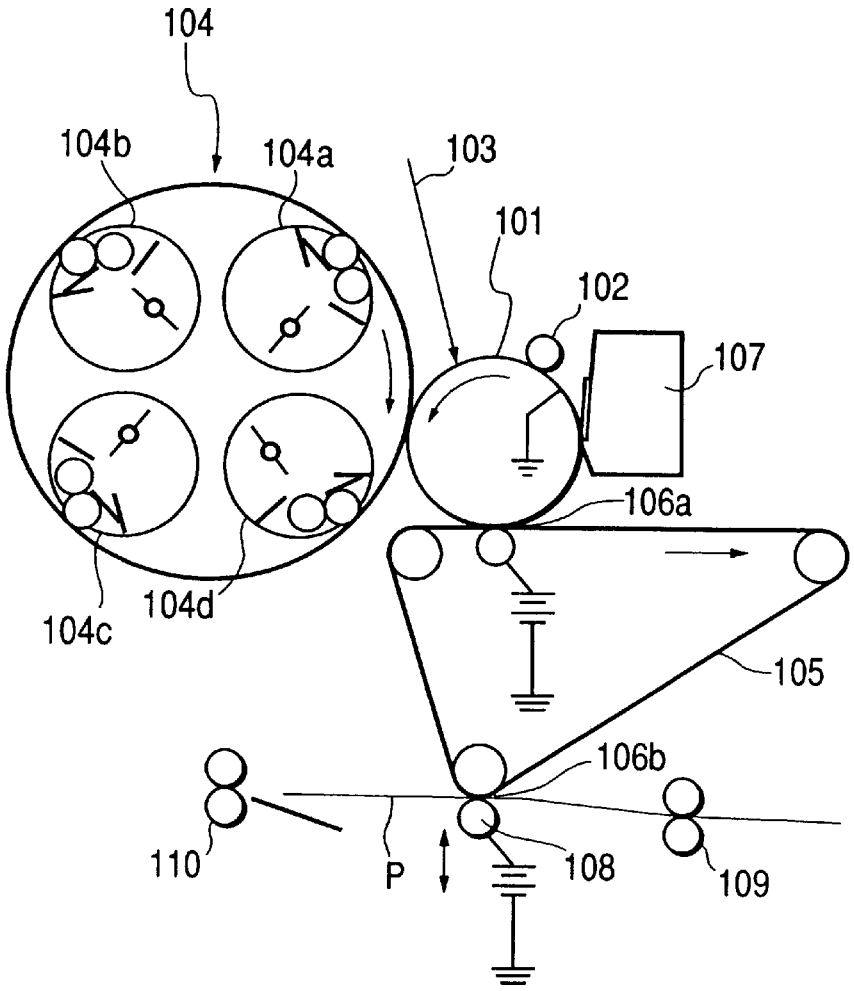
FIG. 5 is a schematic view showing a conventional image forming apparatus.
Figure 6:
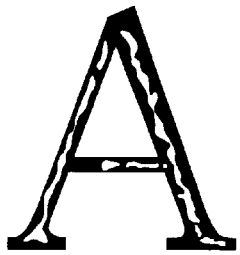
FIG. 6 is a view showing an example of an image having void obtained by the conventional image forming apparatus.

FIG. 4 is a schematic view showing an image forming apparatus (laser beam printer capable of forming a color image) according to a second embodiment of the present invention.

In the second embodiment, an intermediate transfer belt 30 is used as an intermediate transfer member, and a transfer roller 10 and a power source 12 are used as a second transfer means. These constitute a transfer device 5. Also in this embodiment, the processes in which the resultant color images are transferred onto a transfer material P collectively and the transfer material P is sent, through a transfer material guide member 34, to the fixing device (fixing means) 6, where the images are thermally fixed to the transfer material are the same as those in the first embodiment. Incidentally, the same elements as those in the first embodiment are designated by the same reference numerals and detailed explanation thereof will be omitted.

In the second embodiment, the toner image formed on the photosensitive drum is once firstly-transferred onto the intermediate transfer belt 30 by a first transfer roller 31 and a power source 9 at a first transfer nip $T_1$ between the photosensitive drum 1 and the intermediate transfer belt 30. By repeating this process, plural color toner images are successively superimposed on the intermediate transfer belt 30. Thereafter, the plural color toner images are collectively transferred from the intermediate transfer belt 30 to the transfer material at a second transfer nip $T_2$ formed between the intermediate transfer belt 30 and the transfer roller 10.

A substrate surface of the intermediate transfer belt 30 is controlled to have volume resistance of $10^5$ to $10^8$ Ω·cm by dispersing Ketchen black (conductive material) into acrylonitrile-butadiene rubber (NBR) or thermosetting urethan elastomer by making much of resistance alone, and a surface layer thereof is formed by dispersing PTFE powder of 200 parts into urethane resin (as binder). In the formation of the surface layer, the surface layer is sprayed on the substrate layer and then is polished. A thickness of the substrate layer is 1 mm and a thickness of the surface layer is 10 $\mu$m. The resistance value of the intermediate transfer belt 30 so formed was $2\times10^7\Omega$. A method for measuring the resistance of the intermediate transfer belt 30 is the same as the method for measuring the resistance of the intermediate transfer drum 7 in the first embodiment.

The intermediate transfer belt 30 is supported by a first transfer roller (drive roller) 31, a secondary transfer auxiliary roller 32 and a tension roller 33 and is rotated in a direction shown by the arrow c by the first transfer roller 31 at a peripheral speed V1 with a difference in peripheral speed 1% or less with respect to the peripheral speed V of the photosensitive drum 1. A first transfer bias power source 9 is connected to the first transfer roller 31 so that predetermined first transfer bias can be applied to the intermediate transfer belt 30 through the first transfer roller 31. Further, the intermediate transfer belt 30 may be reinforced by metallic fibers such as SUS or carbon fibers to prevent elongation of the belt.

Also in the second embodiment, as is in the first embodiment, the values $V_1$, $V_2$, $V_3$ and $V_4$ are selected to satisfy the above relations (1) and (2).

By setting the peripheral speed relation between the intermediate transfer belt 30 and the units (transfer roller 10, pair of regist rollers (convey means) 19, heat roller 6*a* and pressure roller 6*b* of the fixing device 6) for conveying the transfer material P to satisfy the above relations (1) and (2), even when the transfer material P is conveyed by any one of the units (transfer roller 10, pair of regist rollers 19, heat roller 6*a* and pressure roller 6*b* of the fixing device 6), the intermediate transfer belt 30 is not braked, thereby stabilizing the peripheral speed.

In this way, also in the second embodiment, as is in the first embodiment, the high quality color image having no poor transferring such as void can be obtained, and deviation (color deviation) caused when the color toner images are superimposed on the intermediate transfer member can be reduced stably.

What is claimed is:

1. An image forming apparatus comprising:

a rotatable image bearing member for bearing a toner image;

a rotatable intermediate transfer member onto which the toner image on said image bearing member is transferred at a first transfer position;

rotatable transfer means for transferring the toner image on said intermediate transfer member onto a transfer material at a second transfer position; and rotatable convey means for conveying the transfer material to said transfer means, wherein the transferring of the toner image from said image bearing member to said intermediate transfer member at said first transfer position and the transferring of the toner image from said intermediate transfer member to the transfer material by said transfer means at said second transfer position can be effected simultaneously, and a conveying speed of the transfer material provided by said convey means is higher than a conveying speed of the transfer material at said second transfer position, and the conveying speed of the transfer material at said second transfer position is higher than a peripheral speed of said intermediate transfer member at said second transfer position.

2. An image forming apparatus according to claim 1, wherein a peripheral speed of said transfer means at said second transfer position is higher than the peripheral speed of said intermediate transfer member at said second transfer position.

3. An image forming apparatus according to claim 1, wherein a distance from a conveying position in which said convey means imparts a conveying force to the transfer material to said second transfer position is smaller than a length of the transfer material in a transfer material conveying direction.

4. An image forming apparatus according to claim 3, wherein, when the transfer material is between said conveying position and said second transfer position, a loop is formed in the transfer material.

5. An image forming apparatus according to claim 1, further comprising a rotatable fixing means for fixing the toner image on the transfer material at a fixing position after the toner image has been transferred to the transfer material by said transfer means, and wherein a conveying speed of the transfer material provided by said fixing means is lower than the conveying speed of the transfer material at said second transfer position.

6. An image forming apparatus according to claim 5, wherein a distance from said second transfer position to said fixing position in the transfer material conveying direction is smaller than the length of the transfer material in the transfer material conveying direction.

7. An image forming apparatus according to claim 6, wherein, when the transfer material is between said second transfer position and said fixing position, a loop is formed in the transfer material.

8. An image forming apparatus according to claim 5, wherein said transfer means comprises a belt, and a distance from a separation position where the transfer material is separated from said belt to said fixing position is smaller than the length of the transfer material in the transfer material conveying direction.

9. An image forming apparatus according to claim 8, wherein, when the transfer material is existed between said separation position and said fixing position, a loop is formed in the transfer material.

10. An image forming apparatus according to claim 5, wherein said fixing means has a pair of rollers for heating and pressuring the toner image on the transfer material for fixing.

11. An image forming apparatus according to claim 5, wherein, when the peripheral speed of said intermediate transfer member at said second transfer position is $V_1$, a peripheral speed of said transfer means at said second transfer position is $V_2$, a peripheral speed of said convey means at a conveying position in which said convey means imparts a conveying force to the transfer material is $V_3$, and a peripheral speed of said fixing means at said fixing position is $V_4$, a relation $V_4<V_1<V_2<V_3$ is established.

12. An image forming apparatus according to claim 1, wherein said transfer means has a belt, and a distance from a conveying position in which said convey means imparts a conveying force to the transfer material to a position where the transfer material starts to be conveyed by said belt is smaller than a length of the transfer material in a transfer material conveying direction.

13. An image forming apparatus according to claim 12, wherein, when the transfer material is existed between said conveying position and said position where the transfer material starts to be conveyed by said belt, a loop is formed in the transfer material.

14. An image forming apparatus according to claim 1, wherein a peripheral speed of said image bearing member differs from the peripheral speed of said intermediate transfer member, and a ratio of the peripheral speed of said intermediate transfer member to the peripheral speed of said image bearing member is in a range of 0.99 to 1.01.

15. An image forming apparatus according to claim 14, wherein the ratio of the peripheral speed of said intermediate transfer member to the peripheral speed of said image bearing member is in a range of 0.995 to 1.005.

16. An image forming apparatus according to claim 14 or 15, wherein the peripheral speed of said image bearing member is higher than the peripheral speed of said intermediate transfer member.

17. An image forming apparatus according to claim 1, wherein said image bearing member can bear plural color toner images, and the plural color toner images on said image bearing member are successively transferred onto said intermediate transfer member in a superimposed fashion at said first transfer position, and the plural color toner images on said intermediate transfer member are transferred onto the transfer material at said second transfer position.

18. An image forming apparatus according to claim 1, wherein a distance from said first transfer position to said second transfer position in a rotational direction of said intermediate transfer member is shorter than a length of the toner image formed on said intermediate transfer member.

19. An image forming apparatus according to claim 18, wherein, at the same time when a last color toner image among the plural color toner images is transferred from said image bearing member to said intermediate transfer member at said first transfer position, the plural color toner images are transferred from said intermediate transfer member to the transfer material at said second transfer position.

20. An image forming apparatus according to claim 17, wherein, at the same time when the plural color toner images are transferred from said intermediate transfer member to the transfer material at said second transfer position, a next toner image is transferred from said image bearing member to said intermediate transfer member at said first transfer position.

21. An image forming apparatus according to claim 1, further comprising charge means for charging residual toner remaining on said intermediate transfer member after the toner image was transferred from said intermediate transfer member to the transfer material at said second transfer position with polarity opposite to normal charging polarity of toner, and wherein, at said first transfer position, at the same time when the residual toner on said intermediate transfer member charged by said charge means is transferred onto said image bearing member, a next toner image is transferred from said image bearing member to said intermediate transfer member.

22. An image forming apparatus according to claim 1, wherein said convey means has a pair of rollers.

23. An image forming apparatus according to claim 1, wherein said transfer means has a roller.

* * * * *

UNITED STATES PATENT AND TRADEMARK OFFICE

CERTIFICATE OF CORRECTION

PATENT NO. : 6,026,269

DATED : February 15, 2000

INVENTOR(S): TAKESHI SETORIYAMA

It is certified that error appears in the above-identified patent and that said Letters Patent is hereby corrected as shown below:

COLUMN 1:
Line 32, "regist" should read --register--;
Line 44, "are trans-" should be deleted;
Line 45, "ferred" should be deleted; and
Line 46, "regist" should read --register--.

COLUMN 2:
Line 7, "regist" should read --register--;
Line 22, "regist" should read --register--;and
Line 52, "which" should read --which are--.

COLUMN 4:
Line 9, "from the" should read --from--;
Line 22, "urethan" should read --urethane--; and
Line 40, Kg" should read --kg--.

COLUMN 5:
Line 13, "images" should read --image--;
Line 14, 'process is called as" should read --a process is called--;
Line 31, "regist" should read --register--;
Line 32, "regist" should read --register--; and
Line 34, "regist" should read --register--.

UNITED STATES PATENT AND TRADEMARK OFFICE

CERTIFICATE OF CORRECTION

PATENT NO. : 6,026,269

DATED : February 15, 2000

INVENTOR(S): TAKESHI SETORIYAMA

It is certified that error appears in the above-identified patent and that said Letters Patent is hereby corrected as shown below:

COLUMN 6:
Line 44, "to" should read --to $10^7 \Omega \cdot cm$.--.

COLUMN 8:
Line 38, "was" should read --were--;
Line 51, "regist" should read --register--; and
Line 66, "regist" should read --register--.

COLUMN 9:
Line 2, "regist" should read --register--;
Line 31, "is" should read --are--;
Line 40, "regist" should read --register--;
Line 41, "regist" should read --register--; and
Line 51, "excessively," should read --excessive,--.

COLUMN 10:
Line 8, "regist" should read --register--;
Line 41, "sought." should read --determined--;
Line 53, "regist" should read --register--;
Line 61, "regist" should read --register--; and
Line 67, "regist" should read --register--.

UNITED STATES PATENT AND TRADEMARK OFFICE

CERTIFICATE OF CORRECTION

PATENT NO. : 6,026,269

DATED : February 15, 2000

INVENTOR(S): TAKESHI SETORIYAMA

It is certified that error appears in the above-identified patent and that said Letters Patent is hereby corrected as shown below:

COLUMN 11:

Line 4, "regist" should read --register--;
Line 9, "regist" should read --register--;
Line 23, "regist" should read --register--;
Line 26, "regist" should read --register--;
Line 29, "regist" should read --register--;
Line 41, "regist" should read --register--; and
Line 50, "regist" (both occurrences) should read --register--.

COLUMN 13:

Line 8, "regist" should read --register--; and
Line 13, "regist" should read --register--.

UNITED STATES PATENT AND TRADEMARK OFFICE

CERTIFICATE OF CORRECTION

PATENT NO. : 6,026,269

DATED : February 15, 2000

INVENTOR(S): TAKESHI SETORIYAMA

It is certified that error appears in the above-identified patent and that said Letters Patent is hereby corrected as shown below:

COLUMN 14:

Line 21, "existed" should be deleted; and

Line 45, "existed" should be deleted.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*